US011330862B2

(12) United States Patent
De Luca

(10) Patent No.: US 11,330,862 B2
(45) Date of Patent: May 17, 2022

(54) DEVICE SUITABLE FOR BEING INTEGRATED IN FOOTWEARS SOLES, ACTING AS CUSHIONING, ENERGY DISSIPATION AND STABILIZATION MEANS

(71) Applicant: BASE PROTECTION SRL, Barletta (IT)

(72) Inventor: Cataldo De Luca, Trani (IT)

(73) Assignee: BASE PROTECTION SRL, Barletta (IT)

( * ) Notice: Subject to any disclaimer, the term of this patent is extended or adjusted under 35 U.S.C. 154(b) by 161 days.

(21) Appl. No.: 16/634,794

(22) PCT Filed: Aug. 2, 2018

(86) PCT No.: PCT/IB2018/055824
§ 371 (c)(1),
(2) Date: Jan. 28, 2020

(87) PCT Pub. No.: WO2019/026025
PCT Pub. Date: Feb. 7, 2019

(65) Prior Publication Data

US 2020/0205513 A1 Jul. 2, 2020

(30) Foreign Application Priority Data

Aug. 3, 2017 (IT) ..... 102017000089835

(51) Int. Cl.
*A43B 13/18* (2006.01)
*A43B 21/32* (2006.01)
*A43B 21/26* (2006.01)

(52) U.S. Cl.
CPC ..... *A43B 13/186* (2013.01); *A43B 21/26* (2013.01); *A43B 21/32* (2013.01)

(58) Field of Classification Search
CPC ..... A43B 21/32; A43B 21/26; A43B 13/186
(Continued)

(56) References Cited

U.S. PATENT DOCUMENTS 4,342,157 A 8/1982 Gilbert
4,815,221 A 3/1989 Diaz
(Continued)

FOREIGN PATENT DOCUMENTS

DE 19836657 A1 2/2000
DE 102005037781 A1 2/2007
(Continued)

OTHER PUBLICATIONS

ISR for PCT/IB2018/055824, Prepared by the EP Patent Office, mailing date Nov. 15, 2019, 4 pages.

*Primary Examiner* — Marie D Bays
(74) *Attorney, Agent, or Firm* — Whitmyer IP Group LLC

(57) ABSTRACT

Device suitable for being integrated in footwears soles, acting as cushioning, energy dissipation and stabilization means, including: a cushioning element made of a first material having a viscoelastic behavior; a conditioning element positioned under the cushioning element and made of a second material having a viscoelastic behavior; and a containing element positioned above the cushioning element and covering also the conditioning element. The cushioning element having first empty regions that are first through holes and second through holes and channels to pushing out the air when the device is subjected to a compression load.

20 Claims, 14 Drawing Sheets

(58) Field of Classification Search
USPC ..... 36/27, 37
See application file for complete search history.

(56) References Cited

U.S. PATENT DOCUMENTS

| | | | | |
|---|---|---|---|---|
| 4,934,072 | A | 6/1990 | Fredericksen et al. | |
| 5,086,574 | A | 2/1992 | Bacchiocchi | |
| 5,092,060 | A * | 3/1992 | Frachey | A43B 1/0072 36/29 |
| 5,493,792 | A | 2/1996 | Bates et al. | |
| 5,704,137 | A | 1/1998 | Dean et al. | |
| 5,718,063 | A | 2/1998 | Yamashita et al. | |
| 6,266,897 | B1 | 7/2001 | Seydel et al. | |
| 7,000,335 | B2 | 2/2006 | Swigart et al. | |
| 7,832,118 | B2 | 11/2010 | Holden et al. | |
| 2002/0121031 | A1* | 9/2002 | Smith | A43B 7/1415 36/29 |
| 2003/0208929 | A1 | 11/2003 | Lucas et al. | |
| 2006/0021252 | A1* | 2/2006 | Throneburg | A43B 17/02 36/44 |
| 2008/0263894 | A1 | 10/2008 | Nakano | |
| 2010/0031530 | A1* | 2/2010 | Abshire | A43B 13/181 36/28 |
| 2010/0281712 | A1* | 11/2010 | Campbell | A43B 13/02 36/28 |
| 2011/0000101 | A1* | 1/2011 | Nakano | A43B 7/144 36/12 |
| 2012/0204451 | A1* | 8/2012 | De Roode | A43B 21/265 36/114 |
| 2014/0259749 | A1* | 9/2014 | Taylor | B32B 3/28 36/29 |
| 2015/0230968 | A1* | 8/2015 | Jaeger | A43B 7/1465 428/161 |
| 2016/0360830 | A1* | 12/2016 | Mitsui | A43B 5/00 |
| 2018/0077997 | A1* | 3/2018 | Hoffer | A43B 13/188 |
| 2020/0205513 | A1* | 7/2020 | De Luca | A43B 7/1485 |
| 2020/0245718 | A1* | 8/2020 | Lesecq | B29D 35/142 |

FOREIGN PATENT DOCUMENTS

| | | |
|---|---|---|
| EP | 2732716 B1 | 1/2015 |
| EP | 2929790 B1 | 12/2017 |

* cited by examiner

DEVICE SUITABLE FOR BEING INTEGRATED IN FOOTWEARS SOLES, ACTING AS CUSHIONING, ENERGY DISSIPATION AND STABILIZATION MEANS

CROSS-REFERENCE TO RELATED APPLICATION

This application is the U.S. national phase of PCT Application No. PCT/IB2018/055824 filed on Aug. 2, 2018, which claims priority to IT Patent Application No. 102017000089835 filed on Aug. 3, 2017, the disclosures of which are incorporated in their entirety by reference herein.

TECHNICAL FIELD

The present invention relates to a device suitable for being integrated in footwears soles, acting as cushioning, energy dissipation and stabilization means.

BACKGROUND

As it is known, a footwear is made of two main elements: the upper and the sole. The upper, that is the upper part of the shoe, is specifically designed to wrap the foot in an ergonomic and comfortable way, while the sole, the part on which the sole of the foot lies, is designed to cushion and stabilize the walk. In order to assure that the sole is able to adequately carry out the functions for which it is imagined, the same sole is typically made of a light, soft and flexible midsole made of an expanded material, and of a more compact tread able to assure a greater resistance to abrasion and a suitable friction with the ground. Indeed, it is known from biomechanical studies that, during a walk cycle, the more critical phase for the human body is the stand of the heel, the so-called "heel-strike", that is the first moment of the interaction foot-soil. This is the phase during which the heel of the foot is projected onwards and, in a fraction of a second, discharges on the ground a force that changes from one time and one time and a half of the body weight of an individual and may also quintuplicate during a jump. The reaction force is, only partially, diminished by the human body through a three-dimensional complex movement of the foot comprised between the area of the heel and the metatarsal, while the remaining part is transmitted at first to the heel, then to the ankles, to the knees, to the pelvis and then, little by little, along the vertebral column up until the cervical area. Such an intense reaction force, if not adequately softened through a sole with cushioning characteristics, can cause serious damages to the tendinous and musculoskeletal structures of the user. This requirement is much more important in the field of occupational safety (Individual Protection Devices), so much that it is regulated through the international regulations ISO 20345:2011 that fixes to 20 Joule the limits of the minimal absorption of energy in the area of the heel, so that a professional footwear can be regarded as adequate.

Many solutions are designed to cushion and reduce the negative effect of the reaction forces created during the interaction foot-soil.

The simplest and cheapest known solutions describe cushioning soles made of a midsole made of a soft and light material, mainly Ethylene Vinyl Acetate (EVA), for what concerns the field of sports footwears, and Expanded Polyurethane (E-PU), in the field of safety (Individual Protection Devices). As a matter of fact, since the levels of stability and cushioning change depending on the values of density and hardness of the material, choosing conveniently the mixture it is possible to attribute to the sole the desired properties.

However, the optimization of the values of density and hardness is made depending on a predetermined load. Since these materials, first of all the EVA, are characterized by a reduced resilience, the resulting peculiarities of the sole cannot be guaranteed depending on the applied load. The application of a recurrent load or higher than that designed, such as that of a worker having a body weight greater than the designed load and/or prolonged use, on a footwear with a midsole made of EVA, could cause a plastic deformation of the latter, in this particular case a reduction of the thickness, that would cause a reduction of the capacity of desired stability and cushioning.

An evolution of the aforementioned footwears with a midsole made of EVA is that of soles with specific cushioning devices, such as systems with springs or elements made of a thermoplastic material with a gel effect, with an air cushion or an encapsulated liquid.

A first example of this kind is outlined by the U.S. Pat. No. 4,768,295 which describes a solution achieved by cushioning elements inserted in the bottom of the sole, made of gel bearings.

A second example is outlined by the U.S. Pat. No. 5,493,792 which describes a solution achieved through cushioning elements inserted between the midsole and the tread, made of an encapsulated liquid.

Another example is the U.S. Pat. No. 7,832,118 that describes a solution achieved through cushioning elements inserted in the midsole, some realized by elastomeric materials and the others by thermoplastic material gel effect with a high damping coefficient.

In addition, the U.S. Pat. No. 6,266,897 describes a solution achieved through cushioning elements with a tridimensional geometry inserted in the tread, filled with incompressible fluids, such as gas or other materials like liquids, foams, viscous materials and/or viscoelastic materials.

Still, the U.S. Pat. No. 5,704,137 describes a solution achieved through a hydrodynamic bearing as cushioning element inserted in the sole.

The U.S. Pat. No. 4,934,072 describes a solution achieved through a bearing positioned in the area of the heel, made of a sealed element divided in two chambers, one containing a mixture of viscous liquids and the other containing gas.

The U.S. Pat. No. 4,815,221 describes a solution achieved through a cushioning system made with strings, positioned in the area of the heel.

The U.S. Pat. No. 4,342,157 describes a solution achieved through the insertion of cushioning elements with an encapsulated liquid such as water, glycerin or mineral oil, positioned in the bottom of the midsole in the area of the heel and the metatarsal heads.

The U.S. Pat. No. 7,000,335 describes a solution that considers the insertion of a cushioning element in the area of the heel, achieved through an encapsulated fluid.

All these solutions involve, however, several issues, including an inadequate stabilization while walking. Because of this, in case of hyper pronation or hyper supination of the foot, such solutions contort mainly exactly in the area of maximum load and react facilitating the movement of the foot until it can cause a dislocation. In addition, these are solutions really expensive because of the complexity of their implementation.

For what concerns the accident prevention footwear, an example of a cushioning sole alternative to that with a midsole made of EP is the sole realized inserting a big portion made of expanded thermoplastic polyurethane (E-TPU) in the area of the heel, right under the assembly insole. It is a solution of "passive" type, that is its energy absorbing capacities rely exclusively on the chemical and physical features of the material, and whose rheologic behavior cannot be modified in a controlled way on the basis of the changing of the load. The known portion is made of a material commercially known as "Infinergy", made by BASF for the athletic field. This hyperelastic material has been tested in compliance with the ISO 8307 standard (sphere bounce test) and DIN 53512 standard (palymbalometer test). Right on the basis of the sports applications for which it has been designed, tests made on this kind of sole have highlighted that during the phase predating the detachment of the heel, the material responds to the reduction of the load with an impulsive reaction also known as "rebound" effect. If on one hand such behavior is really useful and appreciated in the athletic field (running, volley, basket) because it assists and supports the propulsive phase of a running or a jump, on the other hand it could reveal itself as extremely dangerous in the "safety" field, where the footwear should dissipate the absorbed energy during a jump not giving it back as an impulsive force. In fact, for applications related to safety, the phase that comes first the "heel off", that is the moment preempting the detachment of the heel from the ground, turns out to be as critical as the support phase of the heel to the ground called "heel strike". In order for the walk to be relaxing and comfortable, during this stage the sole should react to the reduction of the load with a modulated push depending on the weight, which helps and accompanies the lifting of the heel gradually. An impulse-type reaction in this phase could, instead, cause micro-traumas to the tendinous and musculoskeletal structures, thus being injurious to the user. This is true, even more so, for a worker who has to make a jump in order to overcome a difference in height, perhaps by wearing very heavy equipment or loads of different kind. Moreover, the technological limits linked to the low density of molding of the aforementioned material (200-300 gr/l), already mentioned as a favorable condition for sports footwears, especially regarding the competition kind, also lead to a particularly yielding product which causes hyper pronation or hyper supination in case of a decentralized load with respect to the heel center, resulting in a high probability of dislocation in the malleolar area.

Another type of solution that is applied in the "safety" field is represented by the soles obtained by inserting special shock-absorbing devices in a gel-effect thermoplastic material in the area of the heel. Although especially designed for this purpose, these products are characterized by a defined geometry which does not vary according to the exercised pressure. Therefore, even in this case, these solutions have a "passive" operational mode, that is, their energy absorption capacities rely exclusively on the chemical and physical characteristics of the material, and whose rheological behavior cannot be modulated in a controlled manner as the load changes. The solutions known so far do not therefore have a mechanical response to the exercised pressure, such as to avoid issues such as dislocations or incorrect positioning of the foot during the walk. The possibility of modulating the mechanical response of the device according to the load could therefore, by analogy, be defined as an "active" type mode of operation. Devices with such a functioning are not yet present in the current state of the art.

In addition, it is known a device, described in the European patent Nr EP12192518.4 by Arbesko, commercially known as "Energy Gel". It is a device of rectangular shape with dimensions of approximately 40×50×15 mm, made of a very elastic thermoplastic material, inserted under the plantar and wedged in a hole formed in the insole and in the polyurethane sole. The aim of the Arbesko's invention is to increase the absorption of energy, thanks to a higher elastic deformation capacity, compared to that of the polyurethane surrounding it.

Another known example, very similar to the Arbesko's product, is described in the European patent proposed by Steitz Secura Nr. DE 10 2005 037 781.5, called "Vario System". Even in this case, the cushioning element is made of a thermoplastic material with an elastic effect, very soft, inserted under the plantar and wedged in a hole formed in the insole and in the polyurethane sole. Its shape is pear-shaped, similar in size to Arbesko's product. Unlike the latter, the product of Steitz is available in four variants, each of them being characterized by a more or less yielding material, depending on the user's body weight.

For both of the said inventions it is possible to point out some limitations related to the reduced overall dimensions of the same inventions and to the rheological behavior of the material of which they are made up. As a matter of fact, the small sizes of both the inventions lead to an absorption capacity restricted to the sole area under the calcaneus. In a real leaning condition, the heel sinks into this little easily deformable element while the surrounding part of the foot impact against the remaining part of the sole which is made of a stiffer material. It follows that as a result of the lab dynamometer tests, the measured energy turns out to be higher than the energy actually absorbed by the user under real-use conditions. In fact, the dynamometric tools focus the applied force on an area smaller than the sizes of the inventions. Furthermore, such a significant difference between the sole stiffness compared to that of the invention, discomforts the user who feels a decreased comfort sensation clearly sensing the transition between the two elements.

A not negligible aspect, in addition, is the flexibility of this kind of materials which, showing a distinctly elastic reaction, act with an impulsive force, proportional to the amount of the absorbed energy.

This produces a pressure peak on the user's heel, with resulting potential micro shocks for each footstep of the walk.

Moreover, being included under the plantar and embedded in a hole created in the insole and in the sole, the use of this kind of inventions is limited to the safety field application since it doesn't allow the placement of the anti-drilling insert, made of fabric, currently used in nearly all of the European protective footwears, as mounting insole.

A solution to these issues is described in the U.S. Pat. No. 5,718,063, where a single structure, or part, and an upper attached to it is described. The sole includes a midsole that absorbs force and a flexible wear resistant sole. The midsole including at least a cushioning element made of a viscoelastic material (gel type, preferably silicone), and a conditioning element of the cushioning element, on which is placed the cushioning element.

A further solution to these issues is described in the patent US2003208929, that refers to a shoe sole, especially sports shoes, in which the sole includes a cartridge cushioning system that includes a plate that distributes the load and deformation elements placed in an area of the sole forefoot in order to provide support and/or cushioning to the forefoot. The shoe sole can include a second cartridge cushioning system which includes a second plate for the deformation of the load and functional elements placed in an area of the heel of the sole in order to drive the foot in a neutral position after the first contact with the ground.

A further solution to these issues has been described in the patent DE19836657 which refers to a polypropylene biaxially oriented multilayer film comprising an intermediate layer containing wax, that grants good barrier properties and a high brightness.

However, also the aforementioned kind of soles don't allow the spill of the air from the interstices of the cushioning element, since this is a sealed system. The air, for this reason, interacts during the compression phase not allowing an optimal control of the mechanical response of the sole.

Furthermore, in the known solutions, there are issues related to the minor perception of comfort that the user feels, due to the small sizes and to the steadiness of the heel along the direction tibia/fibula in order to prevent the movements of pronator fellows (or supinates) from turning into hyper pronation movements (or hyper supination) with a consequent high probability of sprains in the malleolus area, or of modulation of the reaction time of the invention with reference to the reduction of the load, so that the push given to the heel during the preparation phase of the flying phase of the walk is adequate and biomechanically compliant.

Another solution is described in the U.S. Pat. No. 5,086,574 which reports an impact damping system for application to sport shoes having a hollow housing of flexible elastomeric material which is softer and more resilient than the insole material of the sport shoe which it is to be removably placed in a cavity in the heel area of the shoe. The inner and outer surfaces of the housing side which are smooth and homogeneous, and there is a top cover with an overhang lip which rests on the insole. One or more replaceable damping discs are inserted into the housing and are held therein by the cover which has downwardly extending pins to engage a groove in the disc and a peripheral flange at the lower end of the housing. This patent discloses a sole shaped in such a way that only a vertical deformation is allowed. The mechanical response of the damping system disclosed in U.S. Pat. No. 5,086,574 is elastic and vertically directed, being a typical sport shoe response.

Another solution is described in the patent US2008263894 that discloses a footwear sole including a plurality of shock absorbing elements that extend from upper and lower plates. In one embodiment, the shock absorbing elements include a plurality of receptacles extending from the lower plate and a plurality of protrusions extending from the upper plate. Each protrusion is associated with one receptacle, and a portion of each protrusion extends into the receptacle. A resilient sleeve surrounds each associated protrusion and receptacle. In another embodiment, a plurality of shock absorbing elements extends from a bridge on one of the upper and lower plates. Anyway, the cited patent doesn't disclose through holes and channels able to push out the air when the device is subjected to a compression load The problem of these solutions is that the air can't discharge efficiently from the shoes during the compression, in use, by a user.

Another problem of known solutions is that the sole is not able to sustain a high load and to act as stabilizing and propulsion mean, not allowing any optimal control of the mechanical response of the sole.

The purpose of the present invention is to provide a device suitable for being integrated in footwears soles, acting as cushioning, energy dissipation and stabilization means and allowing the efficient discharge of the air from the shoes during the compression by a user.

The purpose of the present invention, having geometrical and mechanical features so as to obtain a different kind of reaction depending on the amount of the load it is subjected to, allowing an optimized mechanical behavior and a distribution of loads and stresses, so as to be practical, comfortable and functional both with the user standing still and while walking or making a jump, therefore having characteristics such as to overcome the limits which still affect the known systems for cushioning, energy dissipation and stabilization.

According to the present invention, a device suitable for being integrated in footwears soles, acting as cushioning, energy dissipation and stabilization means is provided, as defined in the claims.

BRIEF DESCRIPTION OF THE DRAWINGS

For a better understanding of the present invention it is now described a preferred embodiment, purely by way of non-limiting example, with reference to the accompanying drawings, in which.

DETAILED DESCRIPTION

Figure 1:
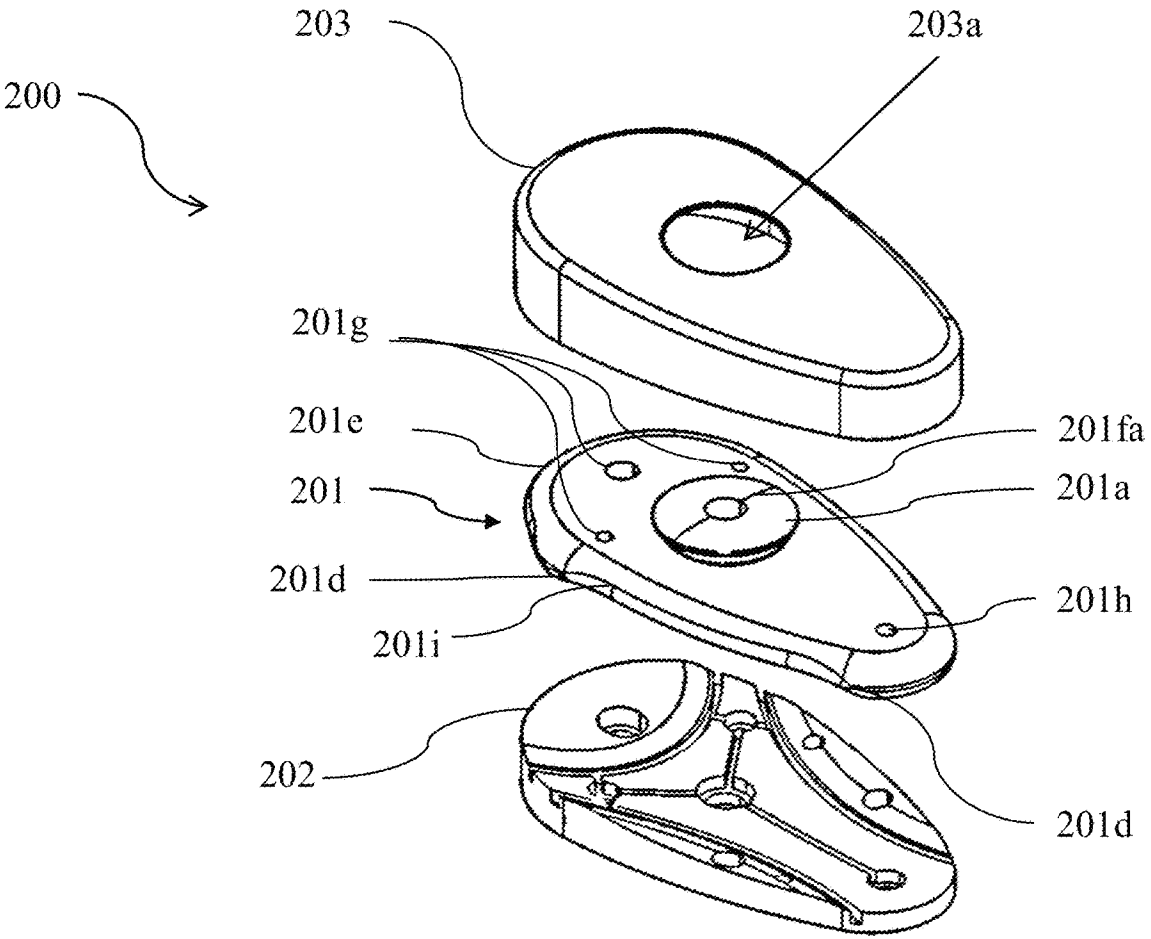
FIG. 1 shows a schematic three-dimensional exploded top view of a first embodiment of a device suitable for being integrated in footwears soles, acting as cushioning, energy dissipation and stabilization means, according to the invention.
Figure 2:
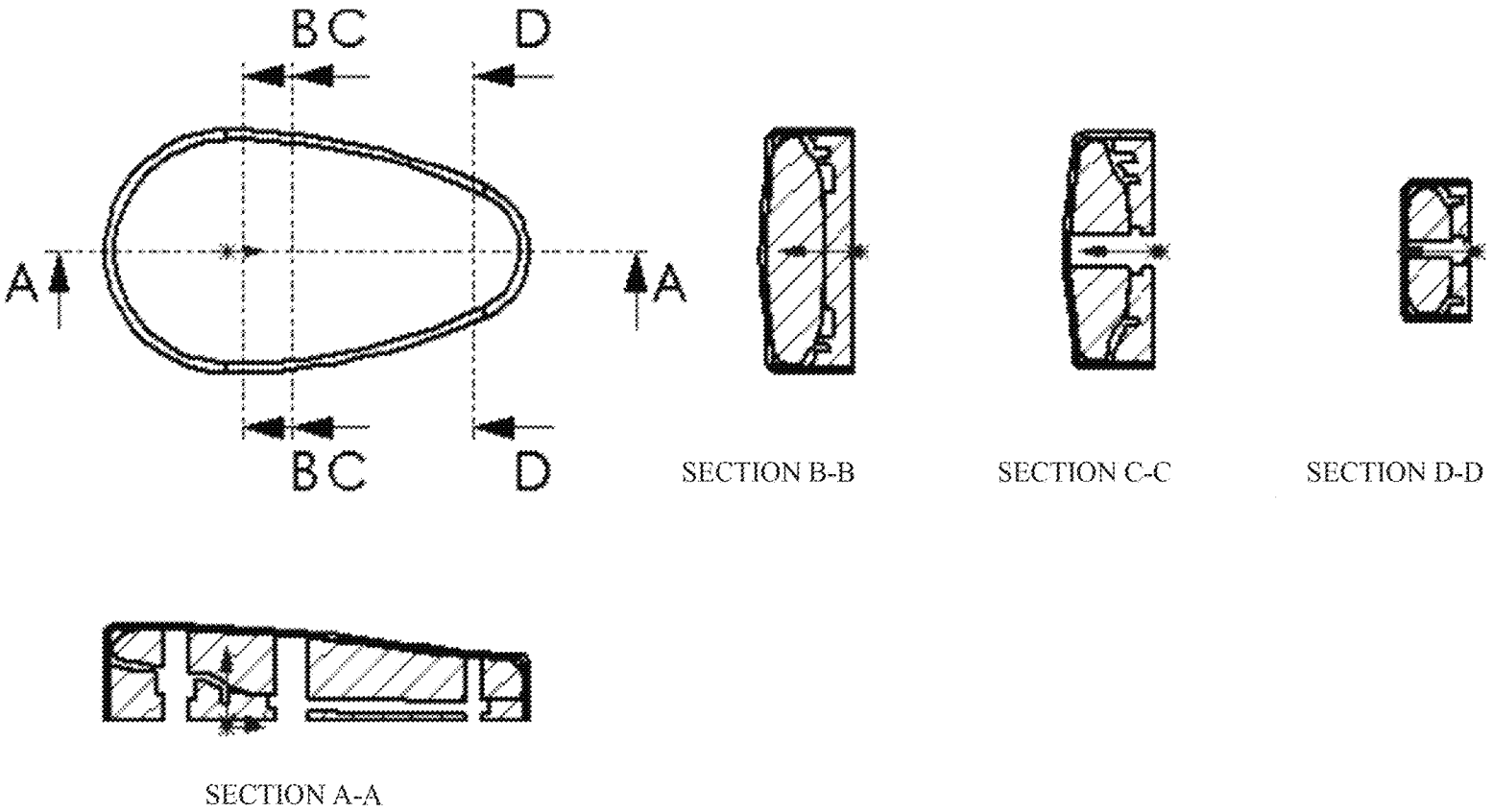
FIG. 2 shows schematic views along the sections A-A, B-B, C-C, D-D of the device suitable for being integrated in footwears soles, acting as cushioning, energy dissipation and stabilization means at the time preceding the "heel strike" phase, that is, before the application of the load, according to the invention.

With reference to these figures and, in particular, to FIG. 1, a first embodiment of a device 200 suitable for being integrated in footwears soles, acting as cushioning, energy dissipation and stabilization means is shown, according to the invention.

Figure 4:
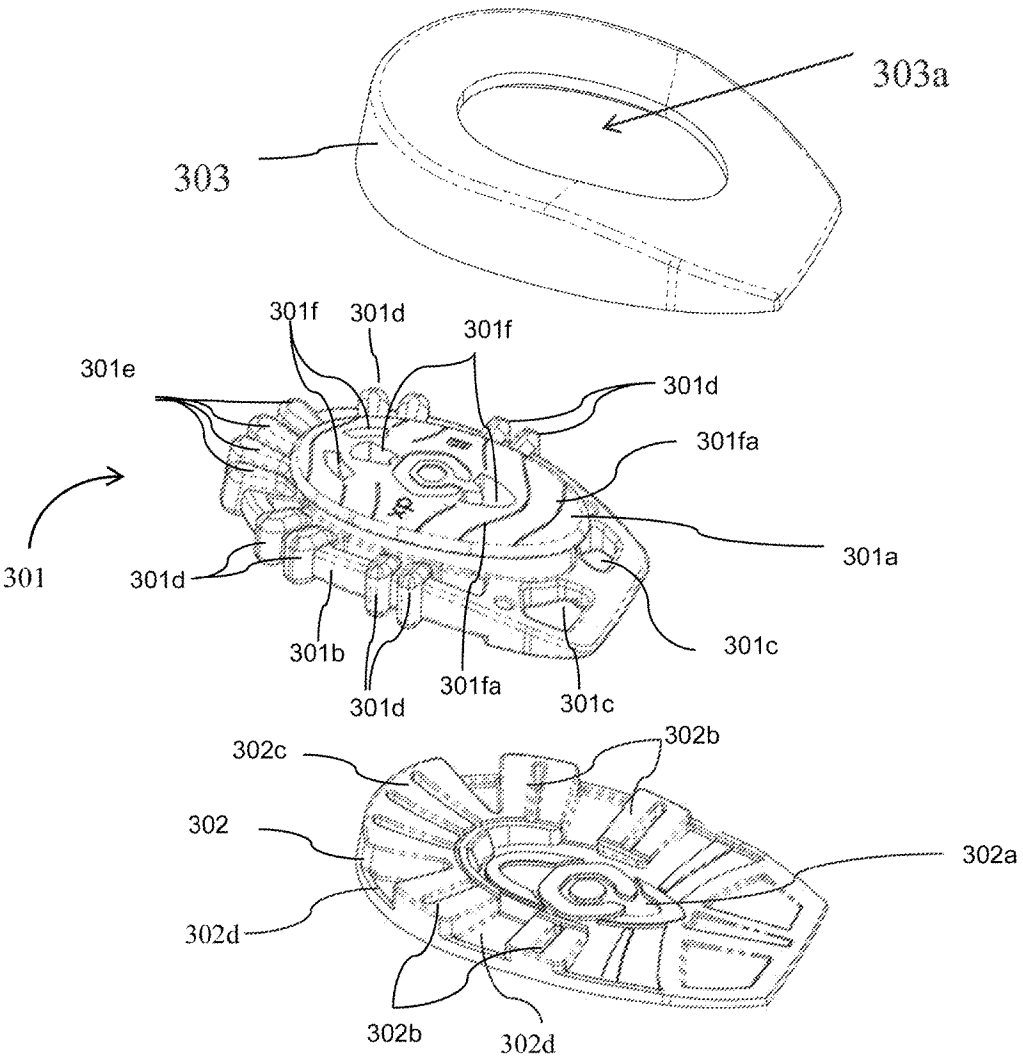
FIG. 4 shows an axonometric top view of a second embodiment of the device suitable for being integrated in footwears soles, acting as cushioning, energy dissipation and stabilization means, according to the invention.

In particular, the device 200, 300 suitable for being integrated in footwears soles, acting as cushioning, energy dissipation and stabilization means, as shown in FIGS. 1 and 4, is a modular device comprising a cushioning element 201, 301, made of a first material having a viscoelastic behavior, positioned over a conditioning element 202, 302 of the cushioning element 201, 301. The conditioning element 202, 302 is made of a second material having a viscoelastic behavior, and more rigid than the first material having a viscoelastic behavior of which the cushioning element 201, 301 is made.

According to an aspect of the invention, the device 200, 300 also comprises a containing element 203, 303 positioned above the cushioning element 201, 301 and covering also the conditioning element 202, 302.

The device 200, 300 is formed by the non-hermetic coupling between the cushioning element 201, 301, the conditioning element 202, 302 and the containing element 203, 303 such as to allow the spill of the air contained in predefined interstices, for example a plurality of holes 201*g*, 201*h* and channels 201*i*, included between the cushioning elements 201, 301, the conditioning elements 202, 302 when the device 200, 300 is subjected to a compression load, in use. In fact, the air present in the interstices at rest, when in use the device is subjected to a compressive stress due, for example, to the walk of a user, pours out from the plurality of holes 201*g*, 201*h*, 301*g*, 301*h*, and channels 201*i*, 301*i* formed in the cushioning element 201, 301 and in the conditioning element 202, 302.

Advantageously, this plurality of holes and channels and the non-hermetic coupling between the elements allows the device 200, 300 to have a controlled and not influenced by the presence of air mechanical response to the compressive stresses.

According to an aspect of the invention, the conditioning element 202, 302 is made of a flexible material but with not negligible features of stiffness.

According to another aspect of the invention, the containing element 203, 303 is made of a flexible material but with not negligible features of stiffness.

Preferably, the conditioning element 202, 302 and the containing element 203, 303 are made of a material chosen among: Polyurethane, rubber, TPU (thermoplastic polyurethane), EVA (ethylene vinyl acetate), polypropylene and other materials that are suitable for the functioning.

In particular, the effect of non-hermetic coupling between the elements allows the device 200, 300 to cause air to come out and, therefore, to have a controlled mechanical response to compressive stresses, not influenced by the presence of air. This non-hermetic coupling is achieved through a pre-defined alternation of regions full of the aforementioned material and of regions empty the same material, which are substantially hollow and, therefore, empty.

In fact, for example, the cushioning element 201 and 301 consists of a structure that comprises a pre-defined alternation of first regions full of the first viscoelastic material and of first regions empty of the first viscoelastic material, able to couple with a corresponding pre-defined alternation of second regions empty of the second viscoelastic material and of second regions full of the second viscoelastic material, or protrusions, of the conditioning element 202 and 302, when the device 200, 300 is subjected to a compression load. In this way, a balance of these regions of the cushioning element 201 and 301 and of the conditioning element 202 and 302 is achieved, in such a way as to allow the spill of air from the empty regions and the desired deformation of the cushioning elements 201 and 301 and of the conditioning elements 202 and 302, so as to confer the desired mechanical features to the device 200, 300.

According to an aspect of the invention, second empty regions of conditioning element 202, 302 are a plurality of second holes 201*h*, 301*h* and channels 201*i*, 301*i* that allow the cushioning element 201, and 301 to be deformed and adapted in a controlled manner. There are also second holes and smaller channels, able to spill the air contained inside the device, when it is subjected to a compression force. Moreover, the conditioning element 202 and 302 comprises peripheral upper protrusions having different heights for a differentiated support, to act as a support. Finally, the surfaces of the peripheral upper protrusions are sloped, creating a central concave surface configured to react to the application of an external load force and to straight foot toward the center of the heel, allowing the device to react to a load application with a centripetal reaction force able to align back any decentralized loads with respect to the center of the heel.

According to an aspect of the invention, the cushioning elements 201, 301, conditioning elements 202 and 302 and containing elements 203 and 303 have a substantially oval shape. In particular, containing element 203 and 303 has a concave surface which follows a heel's curvature and, together with the conditioning element 202, defines a volume within which the cushioning element 201 can warp.

According to a second embodiment of the device 200 according to the invention, as shown in FIG. 1, the containing element 203 has a central ventilation hole 203*a* and the cushioning element 201 has a central protrusion 201*a* able to be coupled to the central hole 203*a*.

Advantageously according to the invention, the central hole 203*a* of the containing element 203 increases the user's comfort perception and facilitate the discharge of the air during the use. Alternatively, the same function of the containing element 203 can be carried out directly by the midsole of the shoe.

Advantageously according to the invention, the shape of conditioning elements 202, 302 and containing elements 203, 303 influence the mechanical behavior of element 201, 301 by means of a pre-defined succession of full material portions and empty portions, as holes and channels, conveniently balanced.

Advantageously according to the invention, the materials of the cushioning element 201, 301, of the conditioning element 202, 302 and of the containing element 203, 303 and their shape allow the device 200, 300 to have an "active" operation mode, that is to be able to obtain a different reaction response in function of the load amount to which it is subjected. This active operation mode, caused by the shape and the materials of the device 200, 300, prevent the incurring of sprains, twist and injuries. The device 200, 300 is therefore different from the state of the art, describing mentioned 'passive' systems, that is systems able to absorb energy by means exclusively of chemical-physical characteristics of the material. Known devices and systems also have a rheologic behavior that cannot be modulated in a controlled manner with the changing of the load.

According to an aspect of the invention, the cushioning element 201 and 301 is made of a material having a high elastic deformation capacity and it is configured to be positioned in the area under the heel of the user. In this way, the cushioning element 201 and 301 enhance the energy absorbing characteristics of the device 200 and 300 during loading ("heel strike"), so as to amortize and slow down the impact velocity between the user's heel and the soil. The cushioning element 201, 301 is made of a material having a rheological behavior that has a delay in the response to a load variation. Therefore, during the phase preceding the "Heel off" moment, i.e. the instant preceding the detachment of the heel, the device 200 and 300 is able to gradually return the energy absorbed and generate a biomechanically compatible thrust that is comfortable, anti-fatigue and above all not harmful to the user's tendon and musculoskeletal structure.

Advantageously according to the invention, the holes and channels formed in the conditioning element 202, 302 and in the containing element 203, 303 facilitate the air eventually comprised in interstice spaces to spill out. Another function of said holes and channels is to allow the cushioning element 201, 301 to deform, also thanks to empty regions, that act as expansion positions of cushioning element and that characterizes the shape and geometry of the device, highly increasing the energy dissipation capacity of the device 200 and 300. Indeed, only a part of the energy absorbed during the loading phase will be transmitted to the user during the unloading phase, or in the phase preceding the detachment of the heel, in the form of a thrust that facilitates the lifting of the heel ("heel off") in a biomechanically compatible manner.

Advantageously according to the invention, the conditioning element 102, 202 and 302 is made of a second viscoelastic material, more compact than other elements, and its shape, together with the containment function of containment element 203 and 303, is configured to make all the reaction forces converge at a same point. In this way the heel is always brought in axis along the tibia/fibula direction, whatever the direction of the applied stress is (pronation or supination).

Figure 3:
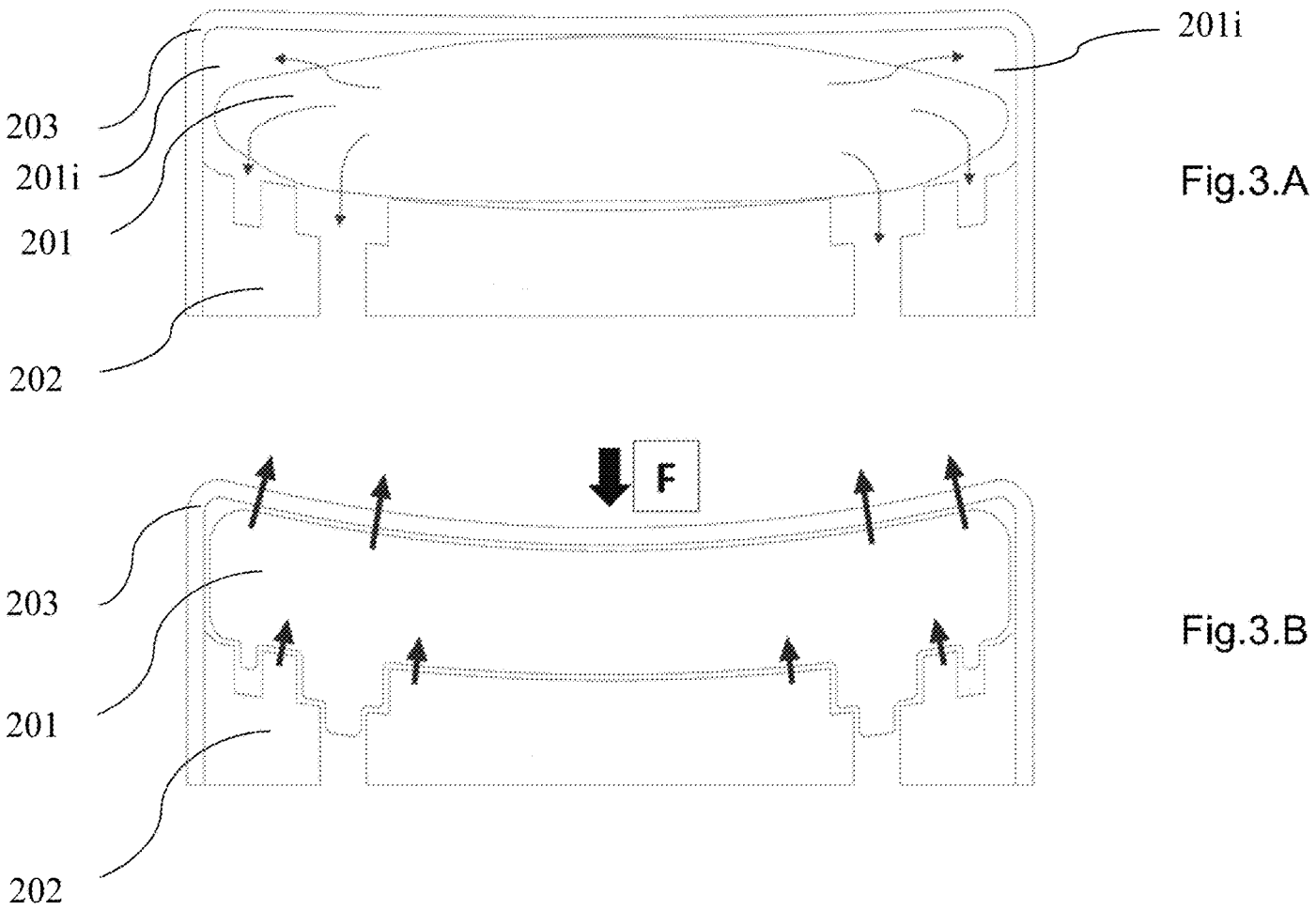
FIG. 3 shows a cross-section of the device suitable for being integrated in footwears soles, acting as cushioning, energy dissipation and stabilization means, before (A) and after (B) the application of the load, according to the invention.

FIG. 4 shows a cross section, for example, of device 200 but the same applies to device 300, before the application of the load (FIG. 3A) and after the application of the load (FIG. 3B). Before the application of the load (FIG. 3A) the device 200 is not compressed; elements 202 and 203 define a volume within which the cushioning element 201 can deform. In the FIG. 3, arrows identify the deformation directions of the cushioning element 201. In the following phase, a compression load F is applied to the device 200 (FIG. 3B); the cushioning element 201 deforms according to the directions indicated in FIG. 3*a*, until the shape of the cushioning 201 is defined by components 202 and 203 jointly. Arrows in FIG. 3.B indicate the direction of reaction forces of the device 200 upon application of the load. Thanks to the geometry and shape of elements 202 and 203, the reaction forces converge towards a single point, acting so as to bring back any loads off-centered with respect to the heel center or having a direction different from a reference condition, ensuring the stabilization of the heel along the tibia/fibula direction.

The Applicant verified that, during the compression of the device 200, 300 by a user, three types of behavior can be identified:

- Low loads: this is the load condition corresponding to a user standing or during a walk. In this phase the response of the device 200, 300 is characterized by a low elastic modulus (that corresponds to a high elastic deformation under reduced loads). In this condition the device 200, 300 slows down the speed of the impact on the ground of the heel and is easily deformed. In case of a user standing upright, the device dampens all the small movements, thus reducing deleterious stresses that may be transmitted to user's musculoskeletal structure. During this phase, the elastic component of the device 200, 300 works more, therefore a large part of the energy will be returned to the user during the unloading phase, with a modulated thrust, in order to facilitate and unload the walk.
- Intermediate loads: this is the load condition corresponding to a user's fast walk, eventually carrying heavy equipment. In this phase the cushioning element 201, 301 deforms according to the geometry defined by both elements 202, 302 and 203, 303. The mechanical response of the device 200, 300 is characterized by a higher modulus of elasticity, the damper component increases and a considerable part of the energy absorbed in this phase will be dissipated, and therefore it will not be returned to the user during discharge phase.
- High loads: this is the reference condition for a user during a jump, possibly carrying heavy equipment. In this phase the cushioning element 201, 301 continues to deform and begins to apply a pressure also on the side portion of containing element 203, 303. Mechanical behavior of the device 200, 300 is characterized by an even higher modulus of elasticity. During this phase the damping component of the device 200, 300 is mostly used, therefore a large part of the energy will be dissipated and will not be returned to the user during the unloading phase Instead, during the decompression phase there is a delay in the device response. The device 200, 300, therefore, does not instantly recovery the deformations caused by compression, when the load is removed this kind of device mechanical behavior ensures a biomechanically compatible thrust on the user's heel.

Figure 5:
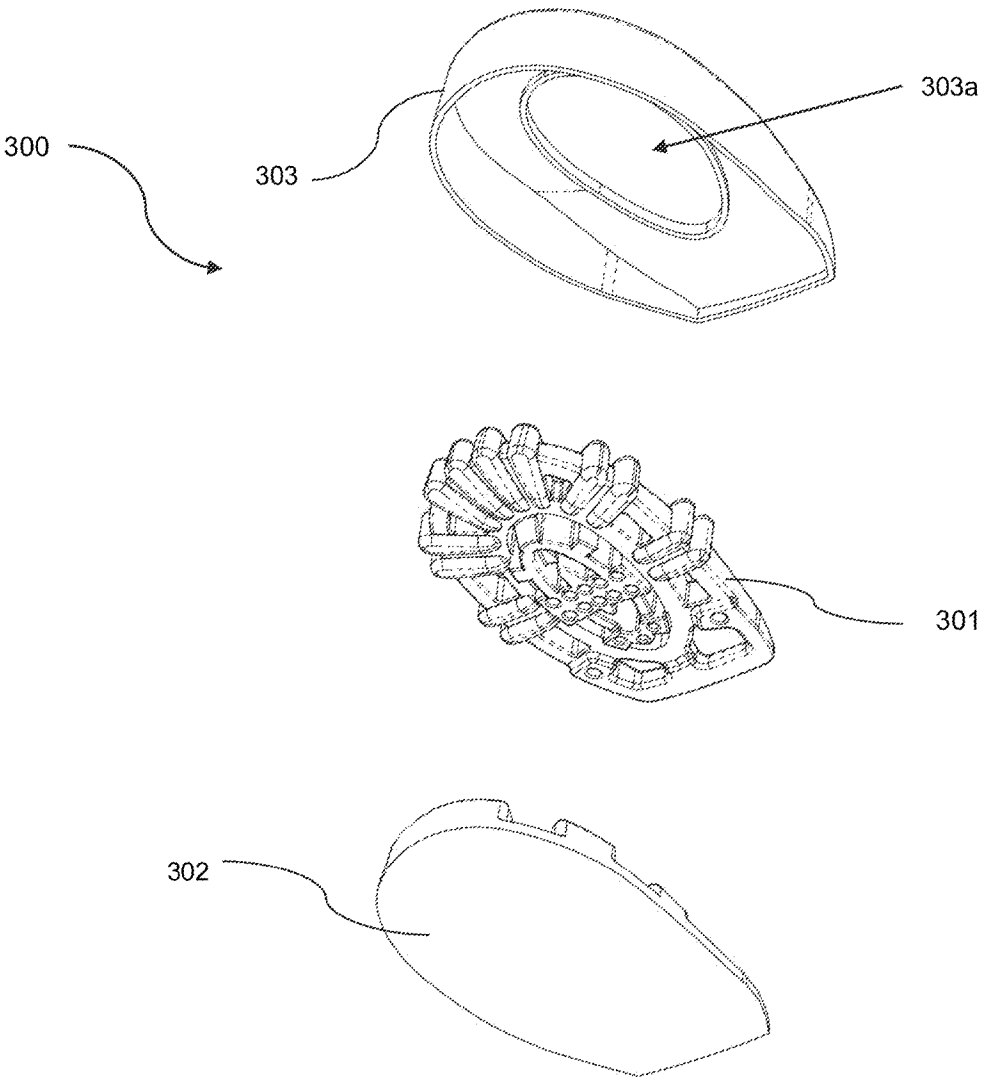
FIG. 5 shows an axonometric bottom view of the second embodiment of the device suitable for being integrated in footwears soles, acting as cushioning, energy dissipation and stabilization means, according to the invention.

A third embodiment is shown in FIGS. 4 and 5, in which the device 300 comprises a substantially oval shaped cushioning element 301, comprising a central plane region 301*a* substantially oval shaped, provided with first through holes 301*f* and with further channels 301*fa*, which allow an improved passage of air inside the device 300 and the sole; and also with a regulating deformation crown 301*b*, for a controlled deformation, peripheral to the central region 301*a*, provided with a plurality of second through holes 301*c* (shown in FIG. 6), at least eight, and with C-shaped side protrusions 301*d*, at least four per side and grouped between them two by two. The regulating deformation crown 301*b* is also provided with at least four C-shaped back gathered protrusions 301*e*, grouped between them, all extending from the upper surface to the lower surface of the cushioning element 301. The protrusions 301*d*, 301*e* extend form the upper surface to the lower surface of the cushioning element 301. The conditioning element 302 of the device 300 is a flat element comprising at the top a central hollow region 302*a* able to engage the central plane region 301*a*, and a peripherical region having a plurality of side protrusions 302*b*, preferably two on each side, and a back protrusion 302*c*. Moreover, all the protrusions 302*b* and 302*c* are spaced out with empty portions 302*d*, at least four, to receive and be a seat for the cushioning element 201, 301, allowing its deformation when a load force is applied.

The containing element 303 is an internally hollow element comprising on its upper surface a central hole 303*a*. Inside the central hole 303*a*, the central regions 301*a* and 302*a* respectively of the cushioning element 301 and of the conditioning element 302, are included.

Advantageously according to the invention, the central hole 303*a* of the containment element 303 has the function of increasing user's comfort and facilitate the spill of air during the use of a sole including the device 300.

Advantageously according to the invention, two of the protrusions 301*d* and 302*b* are placed laterally inside the sole and are useful in the case of supinator foot, other two protrusions 301*d* and 302*b* are placed laterally outside the sole and are useful in case of pronator foot.

Advantageously according to the invention, the rear protrusions 301*e* and 302*c* allow to stabilize the foot, to provide propulsion and to favor walking during the "heel off" phase.

Advantageously according to the invention, the protrusions 301*d*, 301*e*, 302*b* and 302*c* optimize and increase the comfort of a user's foot.

Figure 6:
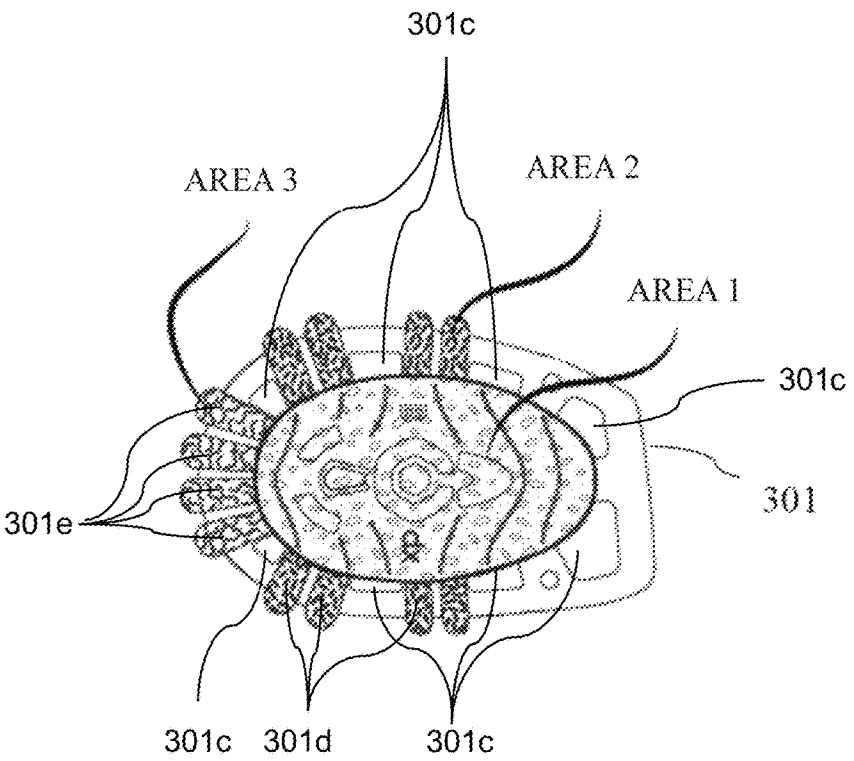
FIGS. 6*a*-6*b* show a top view of the second embodiment of the device as shown in FIGS. 4 and 5, and of the cushioning element of the second embodiment, according to the invention.
Figure 6:
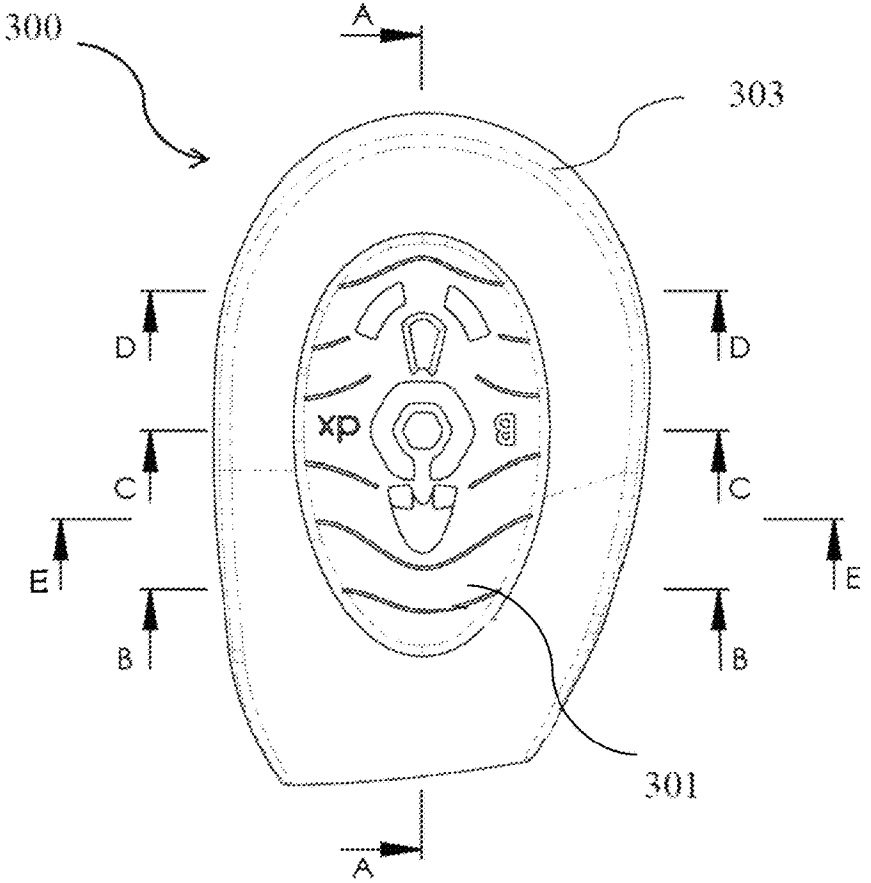
Figure 7:
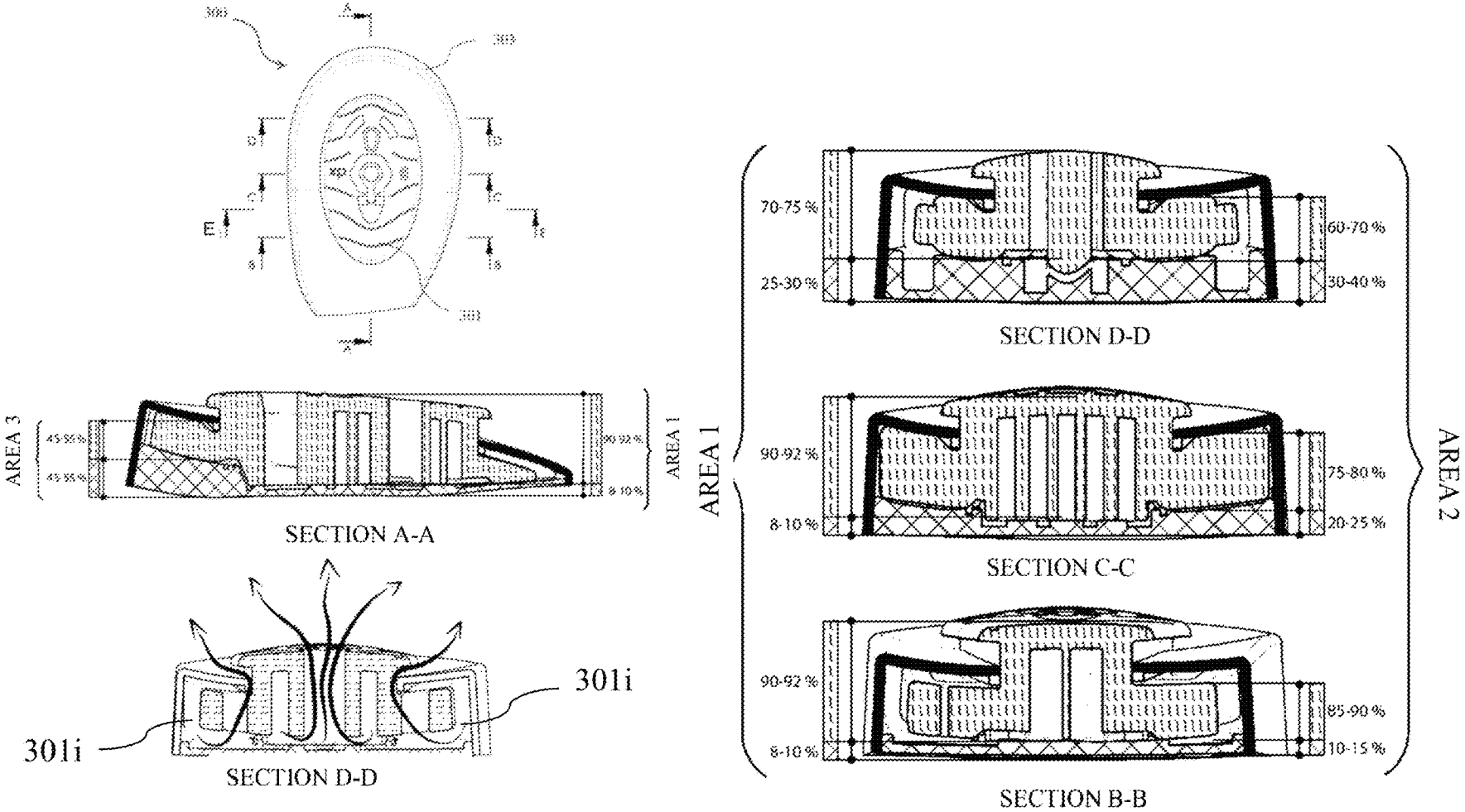
FIG. 7 shows section A-A, B-B, C-C, D-D ed E-E of the second embodiment of the device as shown in FIGS. 4 and 5, according to the invention.

FIG. 6 shows an upper view of the device 300 and an upper view of the cushioning element 301, wherein three different functionality areas of the cushioning element 301 are indicated. FIG. 7 shows section view, in particular A-A, B-B, C-C, D-D and E-E, of device 300, wherein the proportions between height of the cushioning element 301 and the height of the conditioning element 302 in the three areas of FIG. 6 are shown. In particular, zone 1 indicates an area corresponding to the central plane region 301*a* of cushioning element 301, area 2 indicates the region corresponding to lateral C-shaped protrusions 301*d*, and area 3 indicates the area of back protrusion 301*e* of cushioning element 301.

According to an aspect of the invention, as shown in FIG. 7, along section A-A the ratio between the cushioning element 301 and the conditioning element 302 in area 3 is comprised in the range 0.45-0.55, while in area 1 it is comprised in the range 0.08-0.10. Along B-B section, the ratio between the cushioning element 301 and the conditioning element 302 is comprised in the range 0.08-0.10 in area 1, and 0.10-0.15 in area 2. Along C-C section the same ratio is comprised in the range 0.08-0.10 in area 1, and 0.20-0.25 in area 2. Along the section D-D said ratio is comprised in the range 0.25-0.30 in area 1, and 0.30-0.40 in area 2.

In E-E section, shown in FIG. 7, the flow of air through the conditioning element 302, which passes through the cushioning element 301 and spill out of the containment element 303.

Advantageously according to the invention, the cushioning element 301 comprises through holes and non-through holes, and the conditioning element 302 comprises channels 301*i*, said holes and said channels allowing the air to flow out of the device 300.

Figure 8:
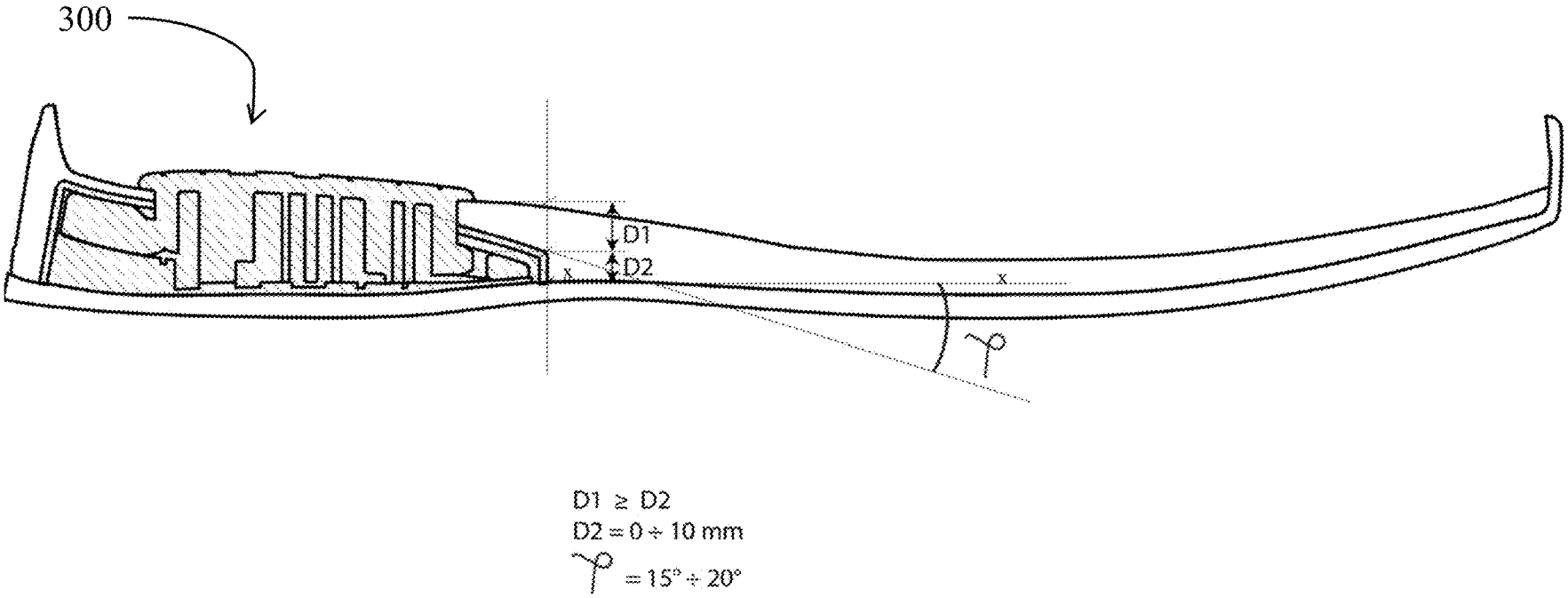
FIG. 8 shows section A-A of the device as shown in FIG. 7 in detail, according to the invention.

FIG. 8 shows a side section of the device 300, in particular the compenetration of cushioning element 301 in conditioning element 302 is shown. Device 300 has a tapered end, that is an upper surface that tends to go downwards, allowing an interpenetration so that the dimension D1 is greater than the dimension D2, both shown in FIG. 8, D2 having a height comprised between 0 mm and 10 mm, and the upper surface of the device 300 decrease, that is have a decreasing height towards a front end, with an angle comprised between 15° and 20° with respect to an horizontal axis x-x.

Figure 9:
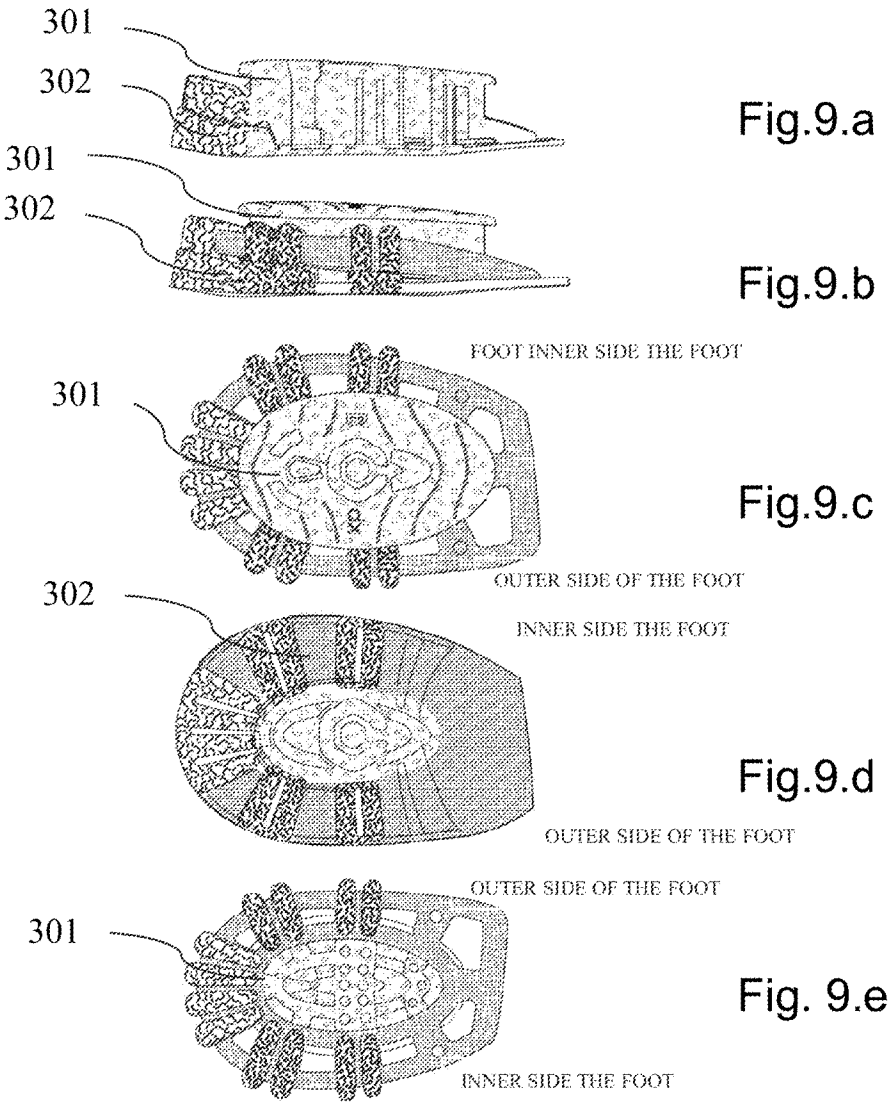
FIGS. 9.*a*-9.*e* show sectional and top views of portions of the second embodiment of the device as shown in FIGS. 5 and 6, according to the invention.

FIG. 9 shows differentiated load bearing capacity regions of the device 300. In particular, FIG. 9.*a* shows, a section of cushioning element 301 coupled to the conditioning element 302, in which a low bearing region corresponds to the central body, with the main function of cushioning at the heel spine area. In the same FIG. 9.*a* is also shown, with a different filling sign, a back portion having high load bearing capacity, for stabilization and propulsion. Moreover, FIGS. 9.*b* and 9.*c* shows, respectively a side view and an upper view, of a medium bearing capacity region, corresponding to independent side protrusions radially arranged to the low-bearing capacity region. The functions of medium-bearing region are to stabilize and bring the foot axis back to a neutral position. Back protrusions 301*e* have a high bearing capacity compared to side protrusions 301*d*, that have medium bearing capacity, and are higher in order to provide an increased support and stability. Moreover, back protrusions 301*e* are advantageously characterized by an upper inclined surface to provide an adequate propulsion during the detachment of the foot from the ground during the deambulation.

FIG. 9.*c* shows the cushioning element 301 of the device 300, highlighting the high bearing capacity region corresponding to the side protrusions and a crown region for connecting the different areas. The crown region is important to obtain a controlled deformation being correlated to the type of mechanical response that the device 300 should provide.

FIG. 9.*d* shows a conditioning element 302 in which are highlighted, in addition to the previous regions, expansion seats for the cushioning element 301 to be deformed under unapplied load.

Figure 10:
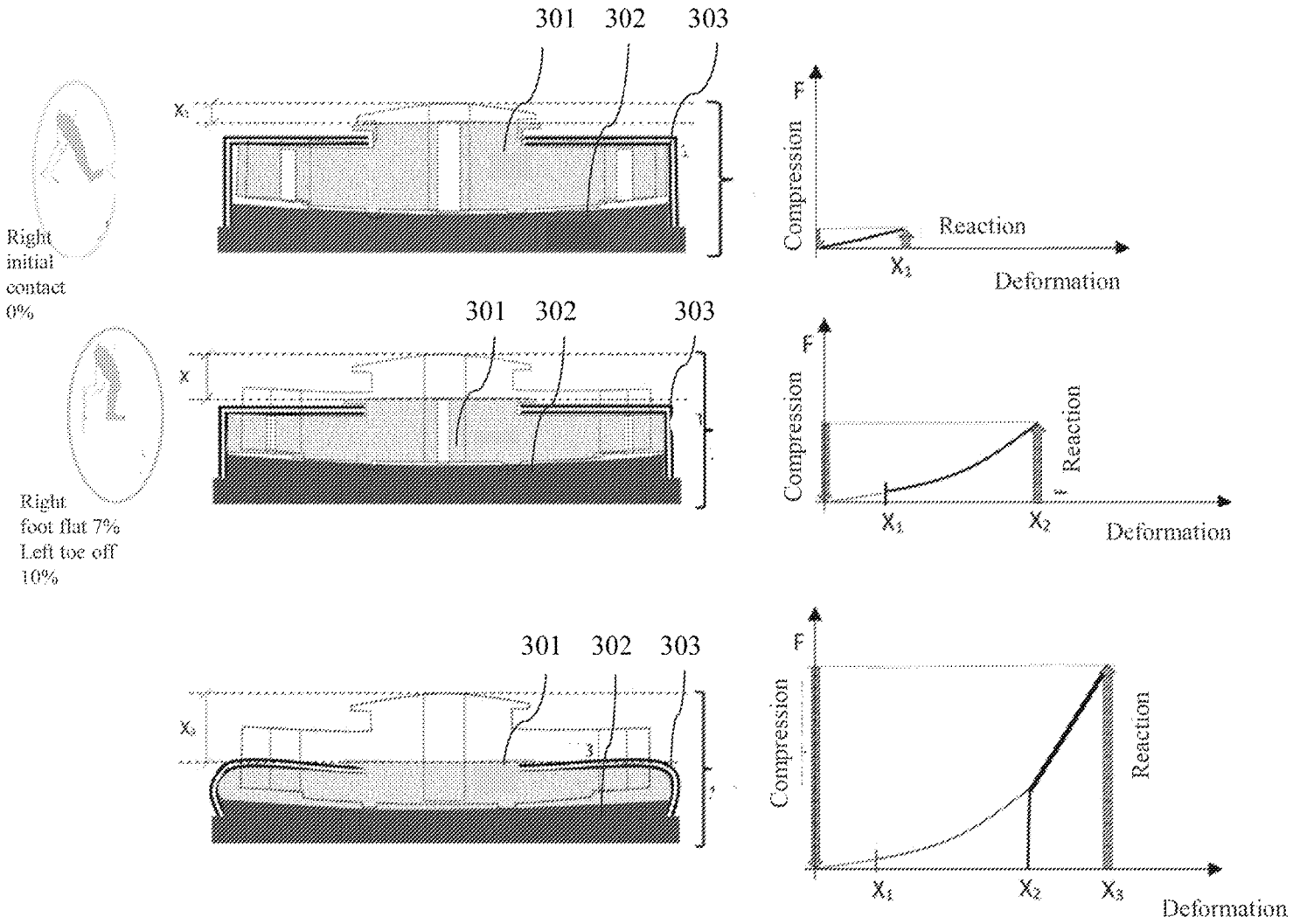
FIG. 10 shows operational schemes during the compression stage of the second embodiment of the device as shown in FIGS. 4 and 5, according to the invention.

FIG. 10 shows a mechanical behavior of the device 300 in use, i.e. the progress of the device reaction depending on the compression force applied to it.

Figure 11:
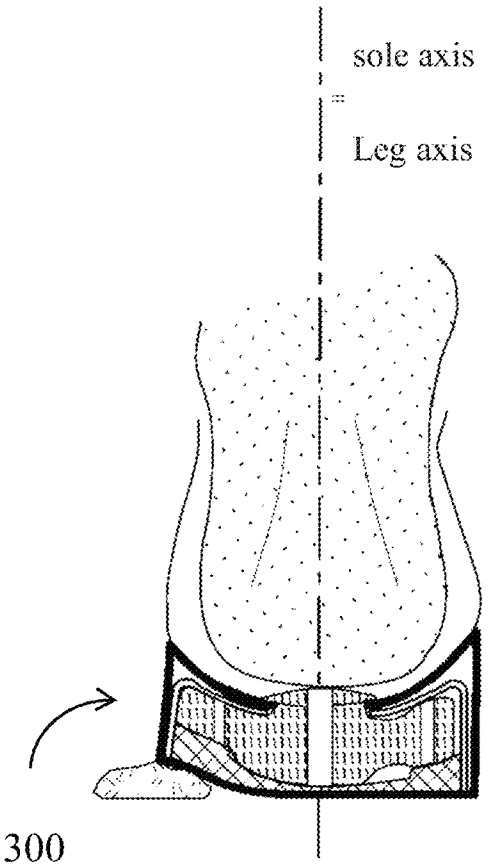
FIGS. 11.*a*-11.*c* show holographic diagrams of the second embodiment as shown in FIGS. 4 and 5, respectively at rest (11.*a*) and in use (11.*b* and 11.*c*), according to the invention.
Figure 11:
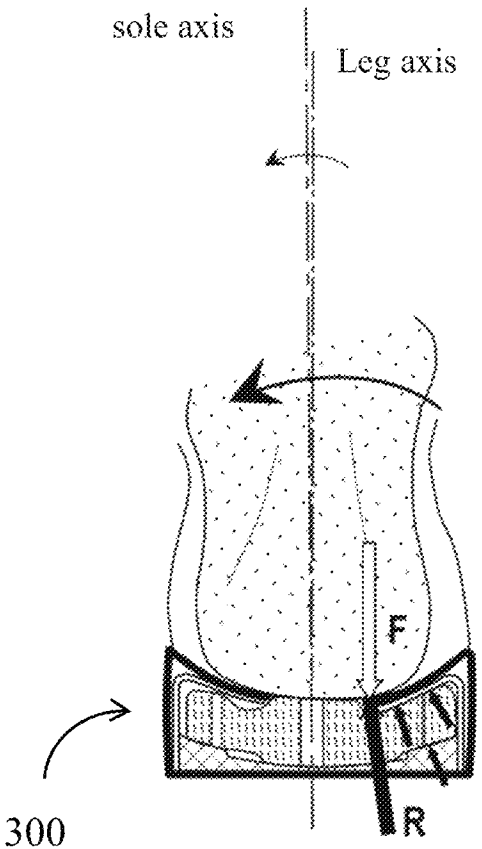
Figure 11:
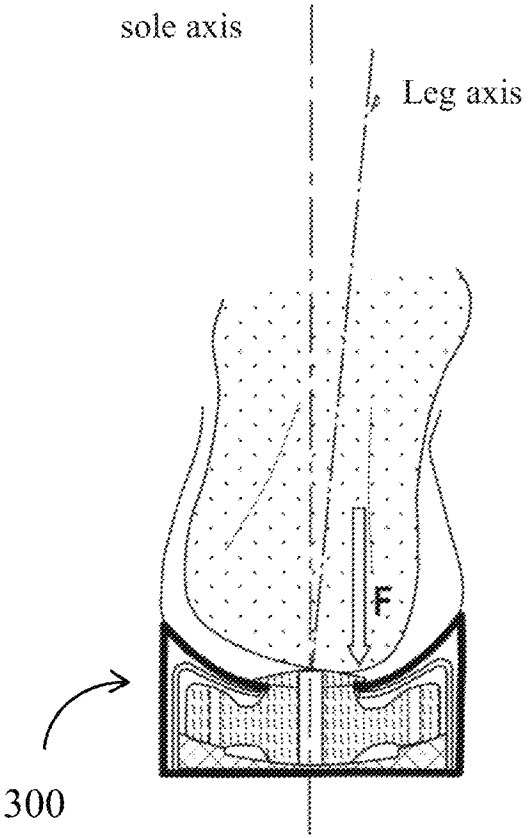

FIG. 11 shows the device 200, 300 integrated in a sole of a footwear and worn by a user. FIG. 11A shows that the axis of the sole forms a certain angle with the axis of the leg at rest, i.e. before the action of the force of compression due to the deambulation. The force of compression F can act centrally with respect to the axis of the sole or sideways, towards inside in case of pronation of the foot, or towards outside in case of supination of the foot. FIG. 11B shows that, as a result of the action of the force of compression F, the device 200, 300 deforms only in the stressed region, without involving the adjacent region. In particular, the device 200, 300 returns a force of reaction to the compression such as to bring the user's leg back on axis, this way preventing mechanical traumas on the lower joints.

Such an advantageous behavior of the device 200, 300 is due to the geometry of the elements 301, 302, 303, to their shape and to the mutual arrangement of full and empty regions. Furthermore, the presence in the device 200, 300 of regions characterized by a differentiated load bearing capacity and the presence of holes and channels that allow the spill of the air, optimize the mechanical response to the compression loads.

FIG. 11.*c* shows how the device 200, 300, thanks to independent areas of reaction, that is regions with differentiated load bearing capacity, is able to dampen any possible roughness from the bottom of the floor or of the ground, advantageously avoiding the rotation of the sole on which the device is applied and the consequent rotation of a user's leg axis. Such an undesired rotation could in fact lead to dislocations and distortions. Therefore, the variable geometry of the device allows an 'active' and advantageous behavior.

Figure 12:
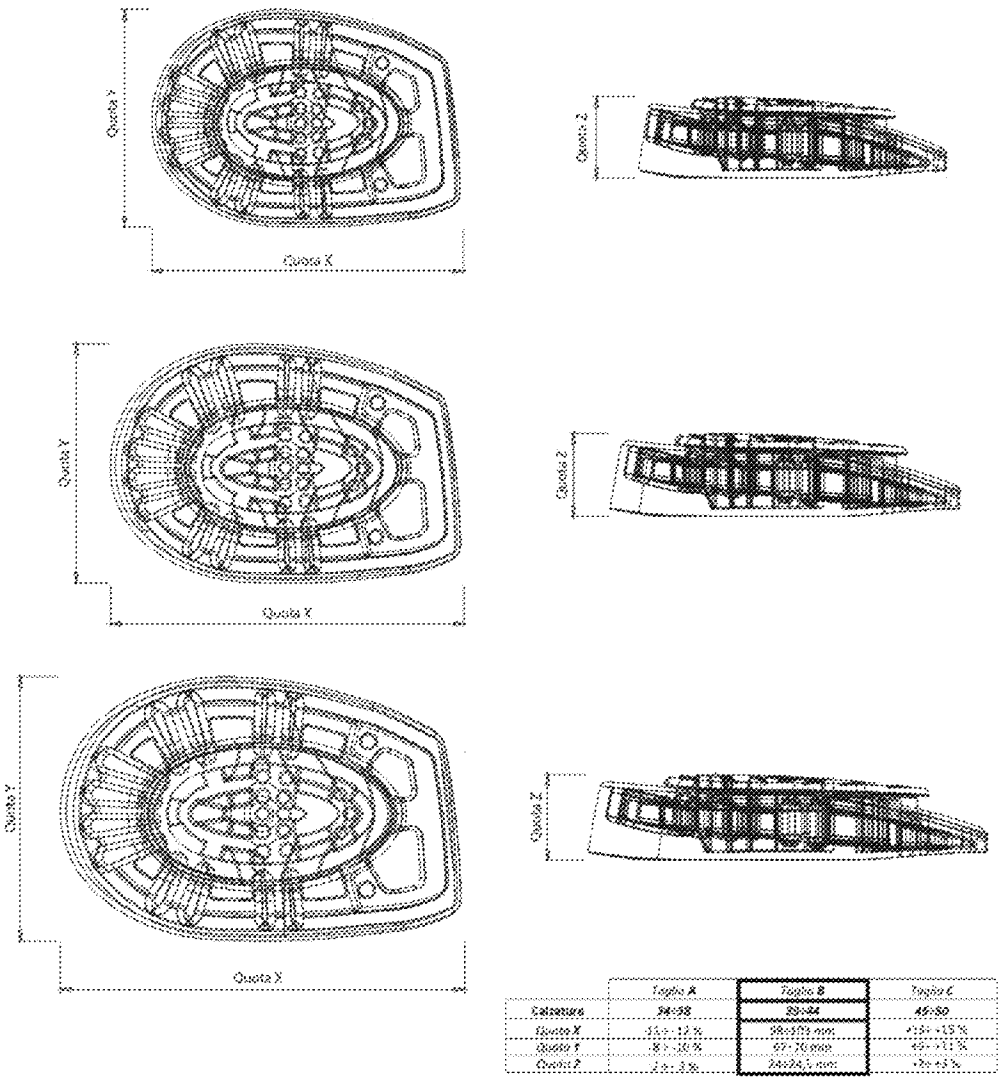
FIG. 12 shows schematic top views from above and in side view of the second embodiment of the device, with indication of the proportions depending on different shoe sizes, according to the invention.

FIG. 12 shows the definition of three different measurements of the device 200, 300 in relation to three shoe size macro-groups. Advantageously, the obtained proportion allows to guarantee the correct relationship between the mechanical response of the device and the body weight of a user.

Figure 13:
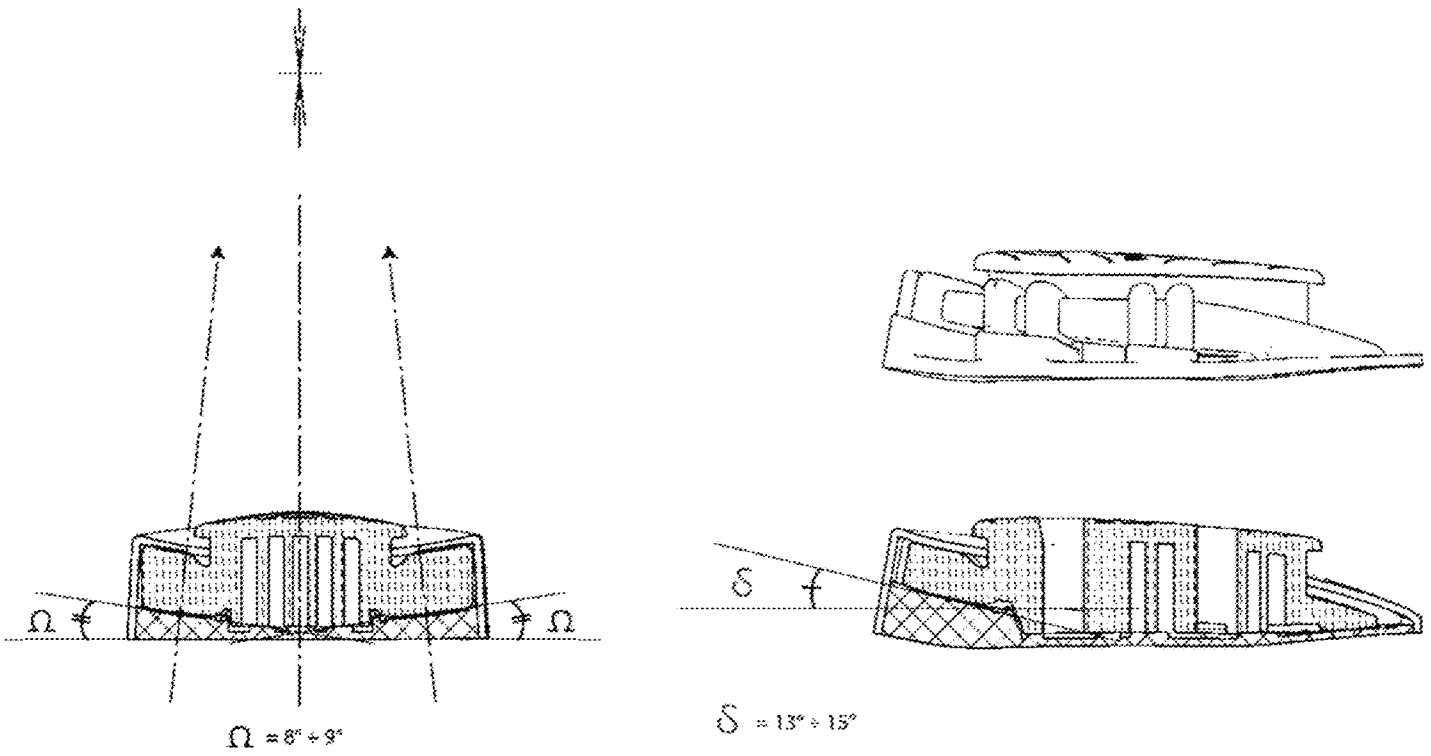
FIG. 13 shows a geometric characterization in longitudinal and transverse section of the second embodiment of the device, according to the invention.

FIG. 13 shows views in section, highlighting geometrical characteristics of the device, in particular side and rear inclinations which allow an easy deambulation, especially when the foot is detached from the ground. In particular, the angle formed between the lower surface of the cushioning element 301 and the ground, with respect to the central axis passing through the heel of the shoe, is called Ω, while the angle formed between the back protrusion 301*e* of the cushioning element 301 and the level of the conditioning element 302 is called δ.

Figure 14:
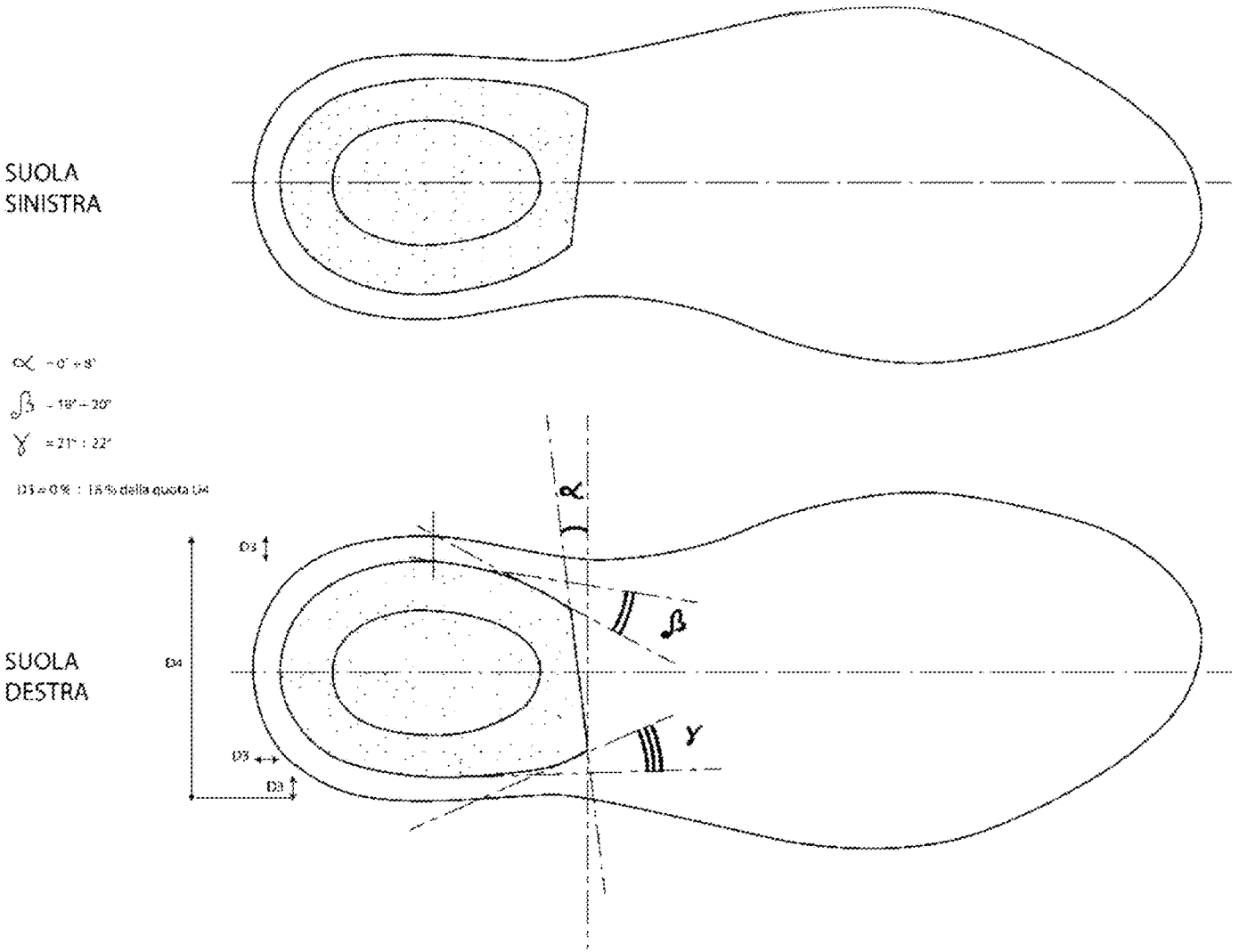
FIG. 14 shows schematic views of the device suitable for being integrated in footwears soles, acting as cushioning, energy dissipation and stabilization means applied to the left and right soles of a footwear, according to the invention.

Finally, FIG. 14 shows an upper view of the device 300 when integrated in the sole of a shoe, where the angles α, β and γ, which define a top view profile of the device 200, 300, are highlighted. In particular the angle α is comprised between 5° and 8°, the angle β is comprised between 18° and 20°, while the angle γ is comprised between 21° and 22°. These angles are configured to ensure greater comfort and support in use. Furthermore, FIG. 14 highlights the positioning of the device 200, 300 when integrated in a sole of footwear, in the rear portion of the footwear itself, near the heel of a user. In order to ensure the correct functioning, the comfort and a maximum stability, the device 200, 300 occupies almost the entire heel portion of the sole supporting the whole area of the heel. The device 300 is therefore integrated in a sole portion corresponding to the heel of a user, at a distance D3 from the outer perimeter of the sole, D3 being comprised between 0% and 18% of a width D4 of the sole in its rear portion corresponding to the heel, as shown in FIG. 14.

According to an aspect of the invention, the device 200, 300 is integrated in the sole of a footwear, in such a way that the conditioning element 202, 302 is an integral part of the sole, being integrated in a sole portion corresponding to the heel of a user, and the cushioning element 201, 301 is arranged above that portion. In particular, the conditioning element 202, 302 corresponds to a portion of the tread of the footwear.

Therefore, the device suitable for being integrated in footwears soles, acting as cushioning, energy dissipation and stabilization means according to the invention allows to absorb and dissipate the energy generated during the first instant of foot-ground interaction ("heel strike") and to limit the deleterious stresses transmitted to the bony joints.

A further advantage of the device suitable for being integrated in footwears soles, acting as cushioning, energy dissipation and stabilization means according to the invention is to be able to adequately modulate the force of reaction during the discharge stage, also known as "rebound" force, in such a way that this is compatible with the user's biomechanical requirements.

Another advantage of the device suitable for being integrated in footwears soles, acting as cushioning, energy dissipation and stabilization means according to the invention is to ensure the stabilization of the heel along the tibia/fibula direction while walking and to avoid one of the main causes of injury on the work, that is the dislocations.

Furthermore, the device suitable for being integrated in footwears soles, acting as cushioning, energy dissipation and stabilization means according to the invention maximizes comfort and stability thanks to the positioning in correspondence with almost the entire heel of the sole, supporting the entire area of the heel.

Finally, the device suitable for being integrated in footwears soles, acting as cushioning, energy dissipation and stabilization means according to the invention allows to maintain its characteristics for the entire life cycle of the footwear.

It is finally clear that the device suitable for being integrated in footwears soles, acting as cushioning, energy dissipation and stabilization means described and illustrated herein can be subject to modifications and variations without departing from the scope of the present invention, as defined in the appended claims.

The invention claimed is:

1. A device suitable for being integrated in footwears soles, acting as cushioning, energy dissipation and stabilization means, comprising:

a cushioning element made of a first material having a viscoelastic behavior comprising a pre-defined alternation of first regions full of the first viscoelastic material and of first through holes and second through holes (201*h*, 301*c*) and channels to pushing out the air when the device is subjected to a compression load;

a conditioning element positioned under the cushioning element and made of a second material having a viscoelastic behavior, more rigid than the first material having viscoelastic behavior, comprising a pre-defined alternation of second regions full of the second viscoelastic material and of second regions empty of the second viscoelastic material, the first regions full of the first viscoelastic material and the first regions empty of the first viscoelastic material of the cushioning element (201, 301) being configured to couple with the corresponding second regions empty of the second viscoelastic material and with the second regions full of the second viscoelastic material of the conditioning element, when the device is subjected to a compression load and a containing element positioned above the cushioning element and covering also the conditioning element;

wherein the first full regions of the cushioning element are side protrusions and back protrusions, the side protrusions and the back protrusions extending from the upper surface to the lower surface of the cushioning element.

2. The device according to claim 1, wherein the side protrusions and the back protrusions are C-shaped.

3. The device according to claim 1, wherein the side protrusions (301*d*) are at least four and gathered by two for each side, and the back protrusions are at least four gathered protrusions.

4. The device according to claim 1, wherein the cushioning element comprises a central plane region comprising the first through holes and channels; and a regulating deformation crown peripheral to the central plane region and comprising the second through holes (301*c*) and said side protrusions and the back protrusions.

5. The device according to claim 1, wherein the second full regions of the conditioning element are two side protrusions on each side and a back protrusion.

6. The device according to claim 1, wherein the conditioning element is a flat element comprising a top central hollow region having a peripheral portion comprising the side protrusions and the back protrusion.

7. The device according to claim 1, wherein the containing element is an internally hollow element comprising on its upper surface a central hole, and being placed in correspondence with the central plane regions and the central hollow region respectively of the cushioning element and of the conditioning element.

8. The device according to claim 1, wherein the cushioning element and the conditioning element comprise: a low bearing capacity region, corresponding to the central plane region; a rear region comprising the back protrusions, having a high bearing capacity; a medium bearing capacity region, corresponding to side protrusions radially arranged to the low bearing capacity region to bring the foot axis back to a neutral position.

9. A sole comprising the device according to claim 1.

10. The device according to claim 2, wherein the conditioning element is a flat element comprising a top central hollow region having a peripheral portion comprising the side protrusions and the back protrusion.

11. The device according to claim 3, wherein the conditioning element is a flat element comprising a top central hollow region having a peripheral portion comprising the side protrusions and the back protrusion.

12. The device according to claim 4, wherein the conditioning element is a flat element comprising a top central hollow region having a peripheral portion comprising the side protrusions and the back protrusion.

13. The device according to claim 5, wherein the conditioning element is a flat element comprising a top central hollow region having a peripheral portion comprising the side protrusions and the back protrusion.

14. The device according to claim 2, wherein the containing element is an internally hollow element comprising on its upper surface a central hole, and being placed in correspondence with the central plane regions and the central hollow region respectively of the cushioning element and of the conditioning element.

15. The device according to claim 3, wherein the containing element is an internally hollow element comprising on its upper surface a central hole, and being placed in correspondence with the central plane regions and the central hollow region respectively of the cushioning element and of the conditioning element.

16. The device according to claim 4, wherein the containing element is an internally hollow element comprising on its upper surface a central hole, and being placed in correspondence with the central plane regions and the central hollow region respectively of the cushioning element and of the conditioning element.

17. The device according to claim 2, wherein the cushioning element and the conditioning element comprise: a low bearing capacity region, corresponding to the central plane region; a rear region comprising the back protrusions, having a high bearing capacity; a medium bearing capacity region, corresponding to side protrusions radially arranged to the low bearing capacity region to bring the foot axis back to a neutral position.

18. The device according to claim 3, wherein the cushioning element and the conditioning element comprise: a low bearing capacity region, corresponding to the central plane region; a rear region comprising the back protrusions, having a high bearing capacity; a medium bearing capacity region, corresponding to side protrusions radially arranged to the low bearing capacity region to bring the foot axis back to a neutral position.

19. The device according to claim 4, wherein the cushioning element and the conditioning element comprise: a low bearing capacity region, corresponding to the central plane region; a rear region comprising the back protrusions, having a high bearing capacity; a medium bearing capacity region, corresponding to side protrusions radially arranged to the low bearing capacity region to bring the foot axis back to a neutral position.

20. A sole comprising the device according to claim 2.

* * * * *